US006213215B1

(12) United States Patent
Breivik et al.

(10) Patent No.: US 6,213,215 B1
(45) Date of Patent: Apr. 10, 2001

(54) SYSTEM, VESSEL, SEABED INSTALLATION AND METHOD FOR PRODUCING OIL OR GAS

(75) Inventors: Kåre Breivik, Tau; Atle Ingebrigtsen, Nesttun, both of (NO)

(73) Assignee: Den Norske Stats Oljeselskap A. S, Stavanger (NO)

( * ) Notice: Subject to any disclaimer, the term of this patent is extended or adjusted under 35 U.S.C. 154(b) by 0 days.

(21) Appl. No.: 09/308,629

(22) PCT Filed: Nov. 21, 1997

(86) PCT No.: PCT/NO97/00312

§ 371 Date: May 26, 1999

§ 102(e) Date: May 26, 1999

(87) PCT Pub. No.: WO98/23846

PCT Pub. Date: Jun. 4, 1998

(30) Foreign Application Priority Data

Nov. 27, 1996 (NO) ..... 965065

(51) Int. Cl.[7] ..... E21B 43/013

(52) U.S. Cl. ..... 166/350; 166/366

(58) Field of Search ..... 166/339, 342, 166/349, 366, 350; 405/190

(56) References Cited

U.S. PATENT DOCUMENTS

| | | | | |
|---|---|---|---|---|
| 3,327,780 | | 6/1967 | Knapp et al. . | |
| 3,455,270 | | 7/1969 | Mascenki et al. . | |
| 3,656,549 | * | 4/1972 | Holbert, Jr. et al. | 166/356 |
| 4,024,718 | * | 5/1977 | Roche et al. | 405/190 |
| 4,192,383 | * | 3/1980 | Kirkland et al. | 166/341 |
| 4,286,665 | * | 9/1981 | Walker | 166/339 |
| 4,378,848 | * | 4/1983 | Milberger | 166/362 |
| 4,625,806 | * | 12/1986 | Silcox | 166/358 |
| 4,819,730 | | 4/1989 | Williford et al. . | |
| 4,972,907 | | 11/1990 | Sellars, Jr. . | |

FOREIGN PATENT DOCUMENTS

| | | |
|---|---|---|
| 0 250 069 | 12/1987 | (EP) . |
| 2 231 356 | 11/1990 | (GB) . |
| 119014 | 3/1970 | (NO) . |
| 171305 | 11/1992 | (NO) . |
| 872588 | 12/1993 | (NO) . |
| WO 95/01904 | 1/1995 | (WO) . |

* cited by examiner

*Primary Examiner*—Frank Tsay
(74) *Attorney, Agent, or Firm*—Foley & Lardner

(57) ABSTRACT

A system for offshore production of oil or gas, comprising a surface vessel having a means for maintaining a desired position and orientation, a bottom installation at the seabed for at least two production wells, and risers for connecting the bottom installation to the vessel. The vessel is provided with drilling equipment for wells at the seabed and with process equipment for produced oil or gas. The bottom installation comprises a template having its foundation at the seabed and being provided with a manifold unit and is designed with at least two well head sections adapted for installing associated Christmas trees. A drill string is adapted to extend from the drilling equipment on the vessel to an operation module at the bottom installation, and a product riser is adapted to connect the operation module to the process equipment on the vessel.

30 Claims, 12 Drawing Sheets

SYSTEM, VESSEL, SEABED INSTALLATION AND METHOD FOR PRODUCING OIL OR GAS

FIELD OF INVENTION

This invention relates to a system for offshore production of oil or gas, comprising a surface vessel having means for maintaining a desired position and orientation, a bottom installation at the seabed, for at least two production wells, and risers for connecting the bottom installation to the vessel. Moreover, in the following specification there is described a method of producing oil or gas with the system, whereby the method initially comprises deployment of the bottom installation at the seabed and the vessel in position at the sea surface above the bottom installation.

BACKGROUND OF THE INVENTION

When developing oil or gas fields at sea the time factor is very significant. The time taken from the drilling of the first well being able to produce, until this well and other wells in association therewith are completed and in full production, should be as short as possible. This has to do, inter alia, with the large investments being made in the form of expensive drilling and production equipment. Also this comprehensive equipment as such should be designed and built aiming at the lowest possible total costs.

BRIEF SUMMARY OF THE INVENTION

One aspect of the present invention is a system for offshore production of oil or gas. The system includes a surface vessel which has an apparatus for maintaining a desired position and orientation, a bottom installation at a seabed for at least two production wells, and at least one riser for connecting the bottom installation to the vessel. The vessel is provided with drilling equipment for wells at the seabed and with process equipment for produced oil or gas. The bottom installation comprises a template having a foundation at the seabed. The bottom installation has a manifold unit. The bottom installation is designed with at least two wellhead sections adapted for installation of associated Christmas trees. The system also includes a drill string adapted to extend from the drilling equipment at the vessel, and a movable operation module adapted to be installed on the bottom installation and to be connected to the lower end of the drill string. The at least one riser includes a product riser adapted to connect the operation module to the process equipment on the vessel.

The system may also include a swivel unit having a vertical axis, in association with the riser. The swivel unit may be located on the vessel, and may be incorporated in the operation module. The swivel unit may be motor driven under control by the apparatus for maintaining the vessel at a desired position and orientation. The swivel unit may have a through-going axial hole for the drill string, and may be underneath a blowout preventer which is also incorporated in the operation module.

The product riser may extend upwards through the water for connection at the vessel at a point at a distance from equipment, abaft on the vessel. The product riser may extend up through the water in an approximate S-shape with an upwardly curved, elevated middle portion of the product riser. The product riser may be attached along a drilling riser for the drill string.

The vessel may be provided with a means for dynamic positioning/orientation.

According to another aspect of the present invention a vessel is provided with drilling equipment for wells at a seabed and with process equipment for produced oil and gas. The vessel includes an apparatus for maintaining a desired position and orientation at the sea surface, and an apparatus for controlling a swivel unit in association with the means for maintaining the desired position and orientation, being based on dynamic positioning and orientation.

The vessel may be equipped with a swivel unit for the upper end of a product riser. The drilling equipment may include an associated work opening, and be located generally midship, and may also have an associated coupling for the product riser. The process equipment may be located abaft.

According to yet another aspect of the present invention a bottom installation includes a template and movable operation module. The template has a foundation at a seabed, and is provided with a manifold unit. The template is designed with at least two wellhead sections adapted for installation of associated christmas trees. The movable operation module is adapted to establish a rotatable connection to a riser extending to a surface vessel.

The movable operation module may include a swivel unit which is motor-driven, and may have a through-going axial hole for a drill string. The swivel unit may be located underneath or over a blowout preventer which may be also incorporated in the operation module.

The operation module may have at a lower portion an interface of the same type as christmas trees intended for being landed and connected to the wellhead sections. The operation module may be provided with a guide yoke adapted to hold product risers extending laterally and at an inclination upwards, with a clearance in relation to remaining components and equipment of the template.

According to yet another aspect of the present invention, a system for offshore production of oil or gas is provided which includes a surface vessel equipped with an apparatus for maintaining a desired position and orientation, a bottom installation at a seabed for at least two production wells, and risers for connecting the bottom installation to the vessel. The vessel is provided with drilling equipment for wells at the seabed and with process equipment for produced oil or gas. The bottom installation comprises a template having a foundation at the seabed. The bottom installation is provided with a manifold unit. The bottom installation is designed with at least two wellhead sections adapted for installation of associated christmas trees. The system further comprises a drill string adapted to extend from the drilling equipment on the vessel to a blowout preventer on the bottom installation. The risers include a product riser adapted to connect one or more production wells on the bottom installation to the process equipment on the vessel.

According to yet another aspect of the present invention, a method of producing oil or gas with a system including a surface vessel, a bottom installation for at least two production wells and provided with a manifold unit and a plurality of wellhead sections, and at least one riser for connecting the bottom installation to the vessel is provided. According to the method the bottom installation is deployed at a seabed, and the vessel is positioned at the sea surface above the bottom installation. A first well is drilled and completed at one of the plurality of wellhead sections. A second well is initially drilled at a second one of the plurality of wellhead sections. The operation module and riser are set down for landing and connection at the second one of the plurality of wellhead sections and the second well is additionally drilled and completed. Production is established for the first well through the manifold and the operation module at the second one of the plurality of wellhead sections, simultaneously with the additional drilling of the second well. A corresponding third well is drilled from a third one of the plurality of wellhead sections and production is subsequently established through the operation module from the third well.

The initially drilling of the second well may include installing both conductor and casing tubes for the second well.

Additional new wellheads may be drilled according to the method. If additional new wells are drilled the operation module may be disconnected and removed from the new wellhead sections after drilling, completing and putting into production a desired number of wells. If additional new wells are drilled, the operation module may also be finally located at a dedicated section of the bottom installation separated from the new well head sections.

It is an object of this invention to provide a system and a method as well as associated components, in particular in the form of a bottom installation and a special vessel, that in an optimal manner makes it possible to fulfill the objects just mentioned.

According to the invention this is obtained by means of the novel and specific solutions being defined in the claims.

In short the concept described here is based on the employment of a drilling vessel which is also equipped with process modules, so that the same vessel can provide for the essential functions both for drilling and for the subsequent production of hydrocarbons. This special vessel is equipped for adequate positioning, e.g. with equipment for dynamic positioning, so that it can lie with the bow against wind and weather and rotate therewith, depending in particular on the wind direction. The connections to the bottom installation concerned in most cases will involve a need for a swivel arrangement. This can be located either at the bottom installation, — or more specifically at the well where drilling is going on, or the swivel can be provided on the vessel. According to the invention, however, it is not excluded that the system and the method can operate also without a swivel. The drill string from the vessel will normally have heave compensation, that usually takes place at the vessel. Such heave compensation does not involve any problems or otherwise has no significant influence on the system described here, or the associated method.

The invention involves the substantial advantage that it will be possible to start production from an oil or gas field and thereby obtain economic gain at a very early time. Moreover there will quickly be obtained information as to how the field concerned produces, at the same time as drilling and completion of wells take place for exploiting the same reservoir.

In connection with the above the drilling vessel can be utilized in an optimal manner in that it has equipment and capacity for processing hydrocarbons, such as crude oil, whereas simultaneously it can perform a drilling operation. Based on production experience from wells being completed and put into production, the drilling programme and completion of subsequent wells can then be optimized, so that the productivity of the field concerned, can be increased as a whole.

BRIEF DESCRIPTION OF THE DRAWINGS

The various aspects and combinations comprised by the invention, will be explained more closely in the following description with reference to the drawings, wherein.

DETAILED DESCRIPTION OF THE INVENTION

Figure 1:
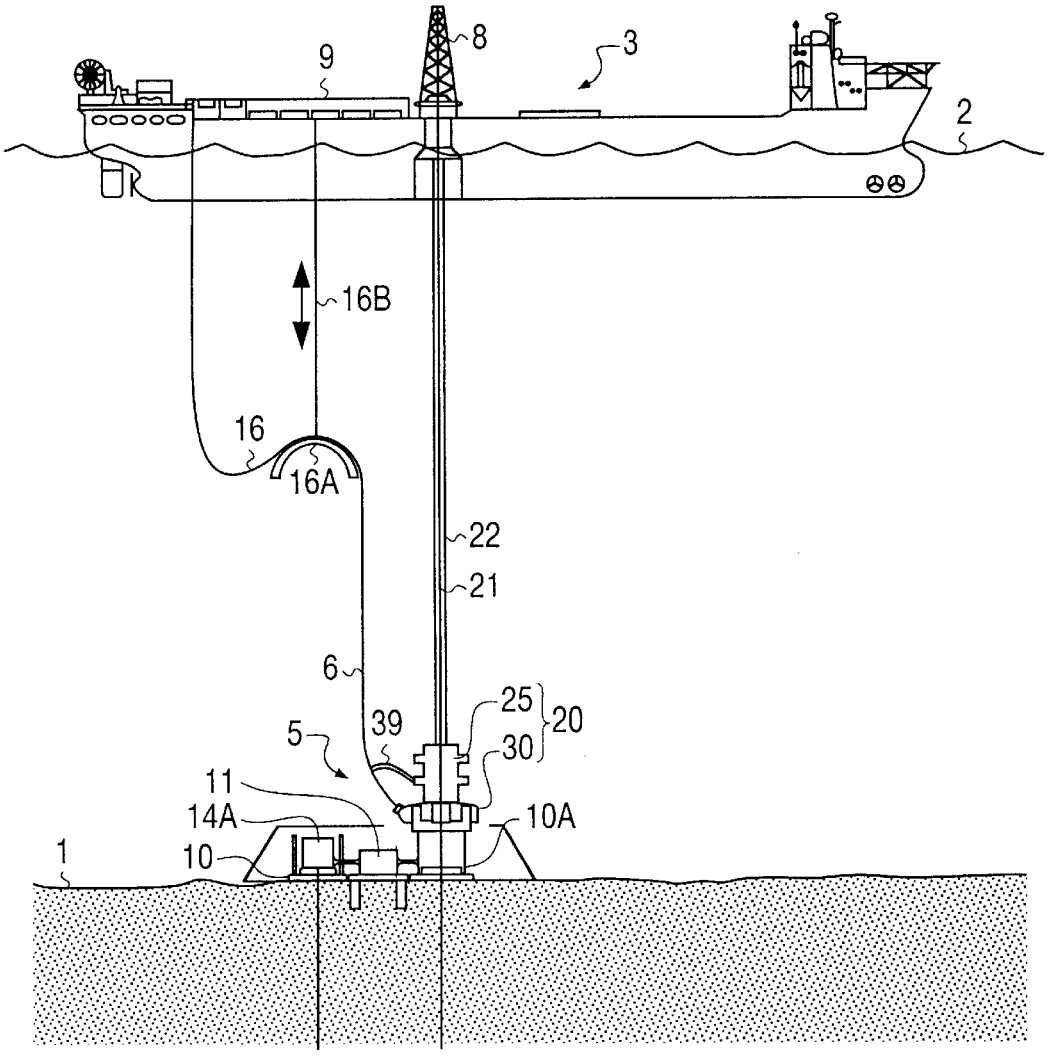
FIG. 1 schematically shows an embodiment of the system according to the invention, where there is included a surface vessel, a bottom installation and risers between the bottom and the surface, FIG. 2 schematically shows an example of an arrangement of the bottom installation as seen in plan view.

In FIG. 1 and several of the other figures of drawings the seabed is denoted 1 and the sea surface 2. A vessel 3 of a specific design has drilling equipment 8 located more or less midship and process equipment 9 for produced oil or gas, located preferably abaft of the drilling equipment 8. Vessel 3 is equipped with means for positioning and orientation, dynamic positioning being advantageous in this context.

There are shown risers for connecting vessel 3 to a bottom installation being generally denoted 5, at the seabed 1. More definitely there is shown a drilling riser or marine riser 22 with a drill string 21, and a product riser 6, which in this example is arranged in a bight or curve 16 over a guide element 16A suspended from vessel 3 and with a possibility of heave compensation as indicated at 16B.

The bottom installation 5 is based on a template 10 which has a foundation in the seabed 1 and among other things carries a manifold unit 11 that can have a design being known per se. Besides the template 10 has a number of wellhead sections or positions as shown more clearly in FIG. 2. In FIG. 1 there is purely schematically illustrated a Christmas tree 14A being located at one of the wellhead sections (13A in FIG. 2). The foundation of template 10 is generally indicated at 10A, and can be made in a conventional way.

At one of the wellhead sections (13 in FIG. 2) of the template, there is installed a particular operation module 20 that constitutes an essential component in several of the embodiments of the invention. As main parts of module 20 there are included a swivel unit 30 and a blowout preventer 25. In this case valve 25 is mounted on top of swivel 30.

For the purpose of drilling operations, vessel 3 is maintained in position above bottom installation 5 by means of dynamic positioning or other means, so that drill string 21 with associated riser 22 can extend as near vertical as possible down from drilling equipment 8 to the blowout preventer 25. As illustrated in FIG. 1 drilling equipment 8 can comprise a usual derrick, drive works and so forth as well as a moon pool as known per se in drilling vessels and platforms.

Even though vessel 3 is maintained in such position that the drill string 21 will have the desired vertical direction, wind and weather will result in turning of vessel 3 so that it preferably at all times has the bow facing the wind or waves influencing the vessel. So as to attend to such turning movements in the system, the swivel unit 30 mentioned above, is provided together with blowout preventer 25 in the operation module 20 at the bottom installation 5. As will be apparent in more detail from FIG. 4, to be discussed below, the product riser at its connection to operation module 20 thus will be able to take part in the turning movements of the vessel without involving any risk of undue mechanical stresses or torques in the structure of bottom installation 5. Swivel unit 30 serves to make possible the required relative rotational movements, and therefore advantageously has a vertical axis coinciding in the principle with the axis of the drill string.

Figure 4:
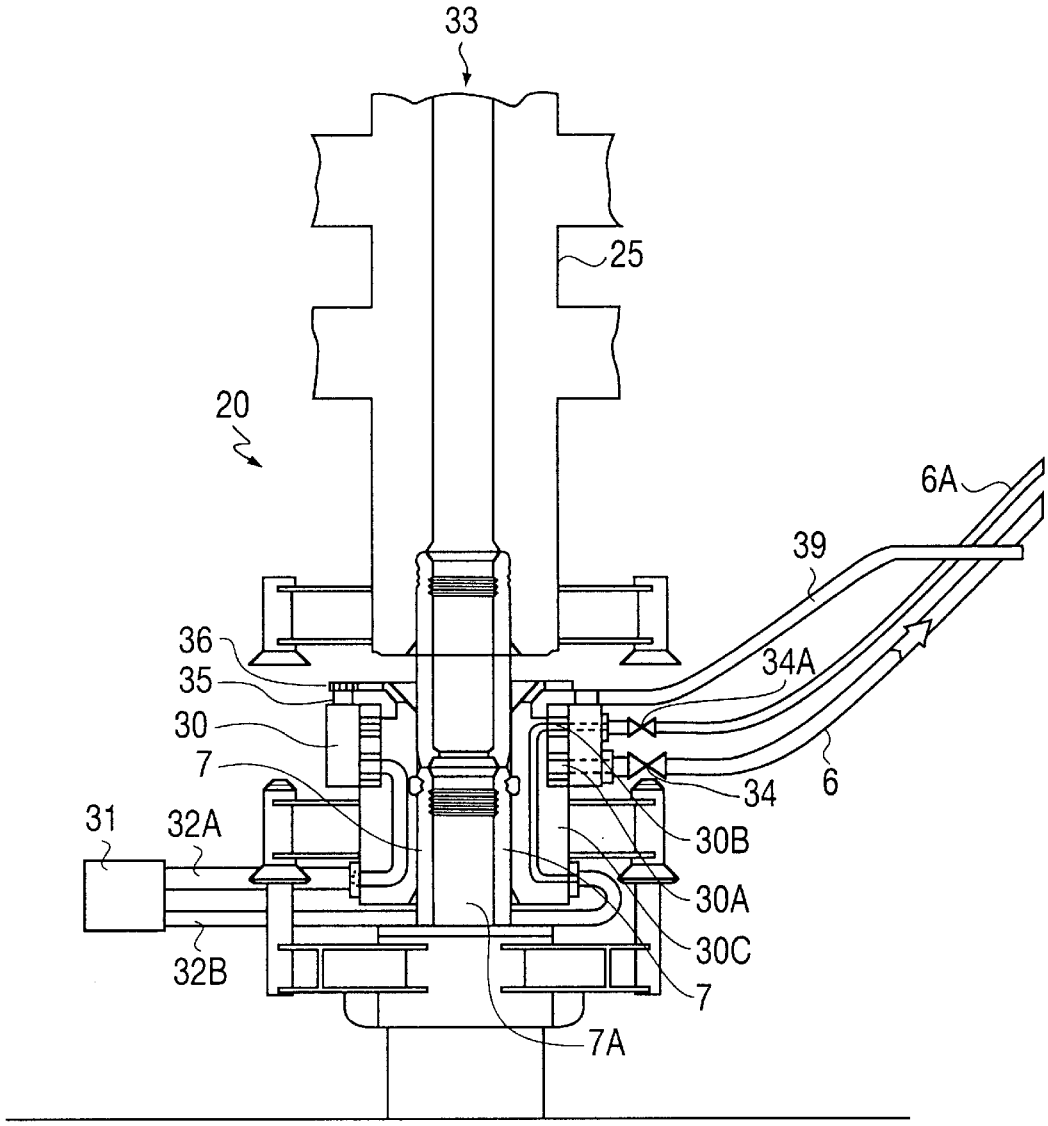

When considering now FIG. 4 the two main parts of operation module 20 are found, namely the blowout preventer 25 (partially shown) and the actual swivel unit 30, the outer members of which are adapted to rotate about the vertical axis mentioned above, so as to follow the turning movements of the vessel at the sea surface. Product riser 6 together with an umbilical 6A extends laterally out from swivel 30 and further at an inclination up through the water. In order to keep riser 6 and umbilical 6A somewhat together and under control so that they do not move into conflict with other components and equipment at the bottom installation, there is provided a guide yoke 39. The actual swivel can be considered to be subdivided into a product swivel part 30A and a control swivel part 30B, whereby the umbilical 6A is connected to the latter swivel part. As known per se, there can here be the question of transfer of electric power and signals as well as hydraulic pressure.

FIG. 4 also shows components belonging to the actual well or wellhead, namely tubes (e.g. of dimension 18 ¾") that constitute the wellhead 7 itself, whereas an inner casing hanger is shown at 7A. With a wellhead coupling 30C the swivel 30 is installed on wellhead 7. Thus coupling 30A belongs to the radially inner and stationary part of swivel 30.

Whereas the rotary movement in swivel 30 in an arrangement as shown in FIG. 1, can take place exclusively under the influence of vessel 3, i.e. through product riser 6 being extended up for connection relatively far abaft on vessel 3, it is preferred in many cases to provide for a motor-driven rotary movement in swivel 30. For this purpose there is provided a crown wheel 36 that is stationary together with the inner swivel parts as mentioned, and a rotation motor having a gear 35 for cooperation with crown wheel 36 and thereby for rotating the outer swivel parts when motor/gear 36 is driven in rotation. This will take place by means of electric or hydraulic power being supplied through umbilical 6A. The angular position to which the swivel is turned, will be controlled from the vessel 3 (FIG. 1) preferably under control by the dynamic positioning means mentioned above, that maintains the vessel at the desired position and orientation.

Drill string 21 with its riser 22 has not been indicated in FIG. 4, but cooperate with blowout preventer 25 in a conventional manner. Valve 25 is mounted on an upper extension of wellhead 7, so that rotationally it is stationary on the bottom installation. The drill string riser being rigidly connected to the top of blowout preventer 25 (see FIG. 1) thus in a usual way has a rotary coupling to vessel 3 at its upper end. A vertical bore 33 for the drill string through blowout preventer 25 continues vertically and centrally through swivel unit 30 and further down into the well.

Figure 2:
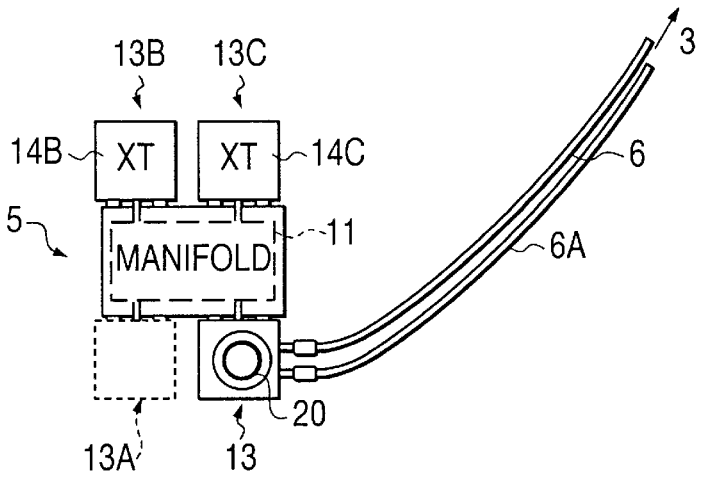

As stationary components associated with the operation module 20 in FIG. 4, there is also shown a laterally projecting coupling 31 intended for establishing connection to other equipment units on bottom installation 5, in particular a manifold 11 as shown both in FIG. 1 and in FIG. 2. Coupling 31 is provided for a production pipe 32A for transferring the hydrocarbon product concerned, from the bottom installation to the vessel through swivel 30 and product riser 6. Besides there is shown a conduit or passage 32B for electric control/monitoring signals and hydraulics, that via swivel 30 continues up to the vessel through umbilical GA. In the embodiment illustrated in FIGS. 1 and 4, where swivel unit 30 is located under blowout preventer 25, a quick disconnection may be required in an emergency situation. For this purpose FIG. 4 shows valves at 34 and 34A for the product riser 6 and the umbilical 6A, respectively. Correspondingly there may in a way known per se be possible to provide for quick disconnection of the upper part of blowout preventer 25 (not shown).

In the embodiment as described thus far, it has decisive significance that swivel unit 30 is incorporated in an independent module (operation module 20) that can have an integrated design and can be used over and over again in a standardized production system for subsea production. Such a swivel or operation module should be adapted to be installed and retrieved by means of normal subsea installation methods. Moreover it must be possible to lock the swivel into existing equipment profiles, e.g. the conventional locking profiles on a wellhead 7, as shown in FIG. 4, and in addition this must be able to be connected to existing pipe line and connector profiles, so that the unit or module can be utilized in a flexible manner in view of various connections on a bottom installation 5, among other things taking into account successive steps in the form of drilling, completing and production thereof.

In connection with the explanation immediately above, it is also important that production coupling 31 on the operation module swivel 30 can be connected to and locked to a cooperating and standardized coupling profile on the manifold (11 in FIG. 1 and 2). With the above described installation and locking of swivel 30 to wellhead 7 by means of the wellhead connector or coupling 30C, there is obtained a well-defined landing and locked position so that making the coupling at 31 against manifold 11 will be simple.

The solution described here means that swivel unit 30 and operation module 20 as a whole are incorporated in the pressurized part of the wellhead and through which drilling takes place. As known per se this means that the structure at all points that are subjected to such stresses, has the required mechanical strength.

As an alternative to what has been described above with reference to FIGS. 1 and 4, the operation module with the swivel can be installed and locked to the actual template structure or the conductor (e.g. 30"). Such a solution would have as a consequence that the swivel module will not be exposed towards the drilling system or the blowout preventer, but will be mounted outside this system.

From what has been described above it will be clearly apparent to experts in this field that operation module 20 when installed at a bottom installation occupies a section or position that is traditionally intended for a Christmas tree. In this connection it is important, as also discussed above, that the coupling profile or interface of the swivel/operation module against the manifold is identical to what is present at the Christmas tree concerned, that will be installed for the actual production, namely when mounted upon termination of drilling of the well concerned. Thus the solution described does not involve introduction of new coupling points or interface points, beyond that which is already standard for a subsea production system.

FIG. 2 shows an example of an arrangement of the main components at a bottom installation 5 as already mentioned above. Manifold 11 constitutes a central component and at both longitudinal sides thereof there are shown wellhead sections 13, 13A, 13B and 13C. At the latter two positions or sections there are installed Christmas trees 14B and 14C. Wellhead sections 13 is here utilized for the operation module 20 mentioned above, that is connected to surface vessel 3 through product riser 6 and umbilical 6A.

Figure 3:
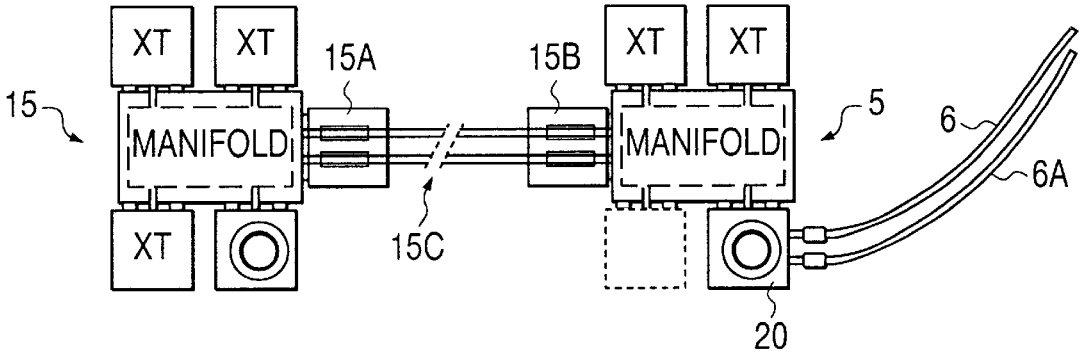
FIG. 3 shows another example of a bottom installation with an increased number of wellhead sections and two manifolds, FIG. 4 in vertical section more in detail shows an exemplary embodiment of an operation module installed at a wellhead.

In the arrangement of FIG. 3 the capacity has been expanded in relation to the arrangement of FIG. 2, since bottom installation 5 has been supplemented with a more or less adjacent bottom installation 15. Between these there are shown pipeline and umbilical connections at 15C, with associated coupling modules 15A and 15B being each connected to one of the bottom installations 15 and 5.

It is obvious that the invention can be employed also in other arrangements or configurations of bottom installations, than the two being illustrated as examples in FIGS. 2 and 3.

Figure 5:
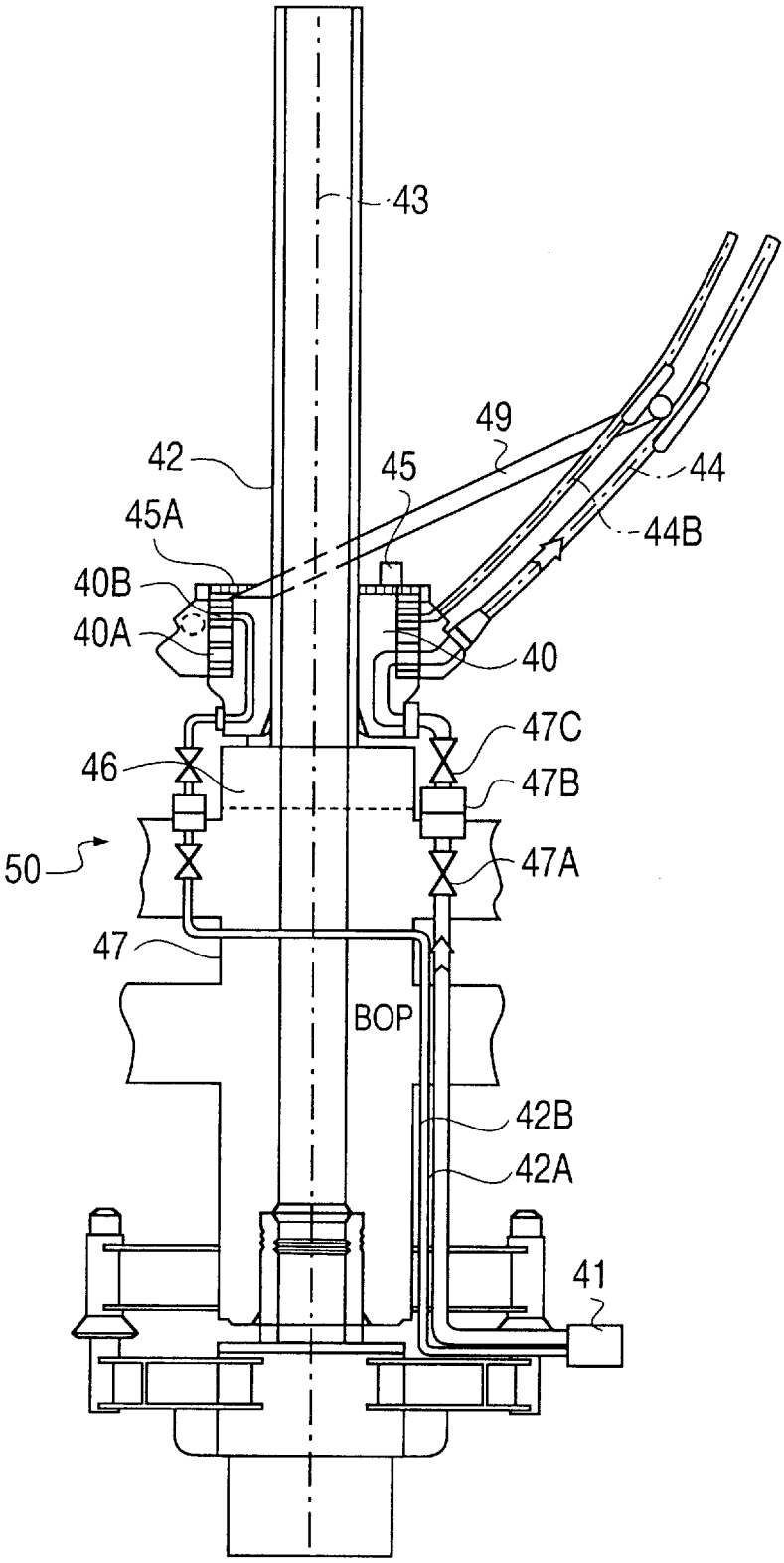
FIG. 5 shows another example of an operation module installed at a wellhead.

In FIG. 5 there is shown an alternative design to the one in FIG. 4, i.e. with an operation module 50 having a swivel unit 40 located above the blowout preventer 47. From drilling riser 42 a through-going axial hole 43 for the drill string continues down through swivel unit 40 and blowout preventer 47. The swivel itself is divided into a product swivel part 40A and a control swivel part 40B corresponding to the embodiment of FIG. 4. Moreover in FIG. 5 there is shown a coupling 41 for connecting operation module 50 to a manifold at the subsea installation concerned, and corresponding connections 42A and 42B leading to the stationary inner parts of the actual swivel 40. The outer, rotatable parts of swivel unit 40 are provided with a guide yoke 49 for the product riser 44 and the umbilical 44B. Finally there is indicated a rotation motor 45 with an associated gear for the rotary movement of swivel 40. With the embodiment of FIG. 5 the riser attachments are removed from the actual subsea structure. The connections 42A and 42B from coupling 41 are extended upwards along and are attached to blowout preventer 47. In an emergency situation the embodiment of FIG. 5 will be based upon quick disconnection from the upper part of blowout preventer 47 at the same time as connections 42A and 42B are disconnected in the same region. For this purpose there is shown a quick disconnect connector 46 for the upper part of blowout preventer 47. If a situation as mentioned above arises, that results in deviation of the vessel from its position during drilling, the valves in blowout preventer 47 will be activated and then disconnection from blowout preventer 47 takes place by means of connector 46. As an illustration at this point it can be mentioned that blowout preventer 47 typically is a module having a height of about 20 meters and a weight of the order of magnitude 200 tons.

Figure 6:
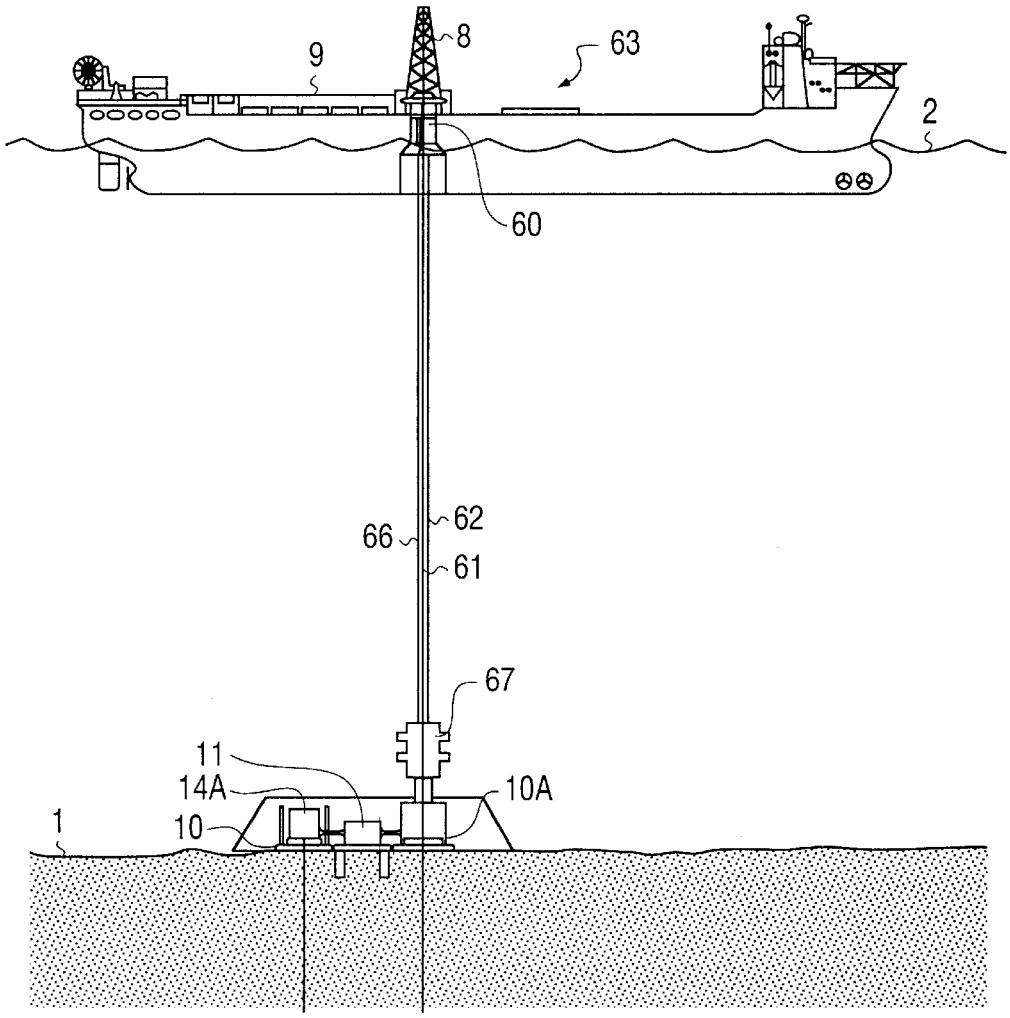
FIG. 6 shows another embodiment of the system based on combined risers and a swivel provided on the vessel.

In the embodiment of the system according to the invention as shown in FIG. 6, the required swivel function is located at the surface vessel 63, as shown at 60, i.e. at the upper end of product riser 66. Moreover FIG. 6 like the preceding figures of drawings, shows a template 10 with a foundation 10A at the seabed 1, a manifold 11 and a Christmas tree 14A as well as a blowout preventer 67 and drilling riser 62 with drill string 61. Such a design gives good access to swivel unit 60. Product riser 66 and an umbilical (not shown) are attached to the outside of drilling riser 62. In this case blowout preventer 67 will also comprise coupling means (not shown) for establishing connection to manifold 11.

As a further simplification in relation to the embodiments described above, FIG. 7 shows an example of a system where there is not employed any swivel unit. Product riser 76A in this embodiment together with umbilical 76B (see enlarged view in FIG. 7A) are mounted to the drilling riser 72. It is possible that product riser 76A and umbilical 76B can extend at a low helical angle about drilling riser 72 over the length thereof, between blowout preventer 77 and vessel 73. Thus there is here provided for a fixed connection of product riser 76A at the subsea installation, which is possible when a flexible design of product riser 76A is employed, so that this riser can endure some twisting. Typically there may here be the question of one degree per meter length of the riser. Accordingly vessel 73 is permitted to rotate within a given sectorial angle that is also depending on the water depth at the location. Larger water depth will make possible a larger turning movement of vessel 73 during operation. Depending on the circumstances it will be necessary in this embodiment to have a relatively high or increased thruster capacity in vessel 73, in order to make it possible to keep this within the permitted angular sector during the limited time required for the drilling of a well.

Figures 7, 7A:
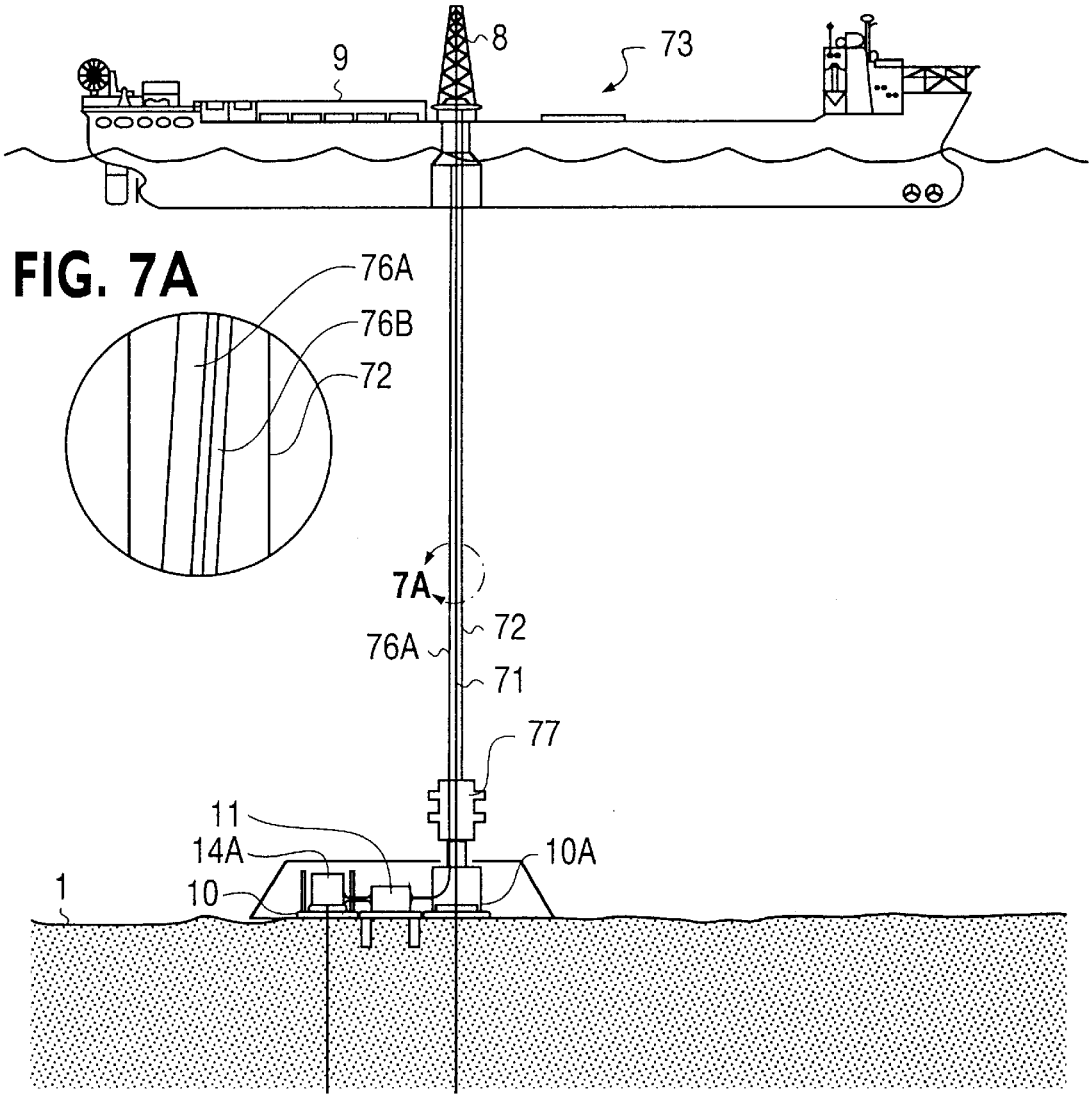
FIG. 7 shows a similar arrangement as the one in FIG. 6, but without a swivel.
FIG. 7A shows an enlarged view of the produce riser, umbilical, and drilling riser of FIG. 7.

In the embodiment without a swivel as illustrated in FIG. 7, it will be expedient to connect product riser 76A and umbilical 76B into a dedicated section of the subsea installation. In an emergency disconnect situation, product riser 76A and umbilical 76B will be disconnected by means of connectors (not shown) at the subsea installation, preferably in association with blowout preventer 77. After such emergency disconnection, product riser 76A and umbilical 76B will normally be removed or retrieved form the bottom installation.

Concerning the specific embodiment in FIG. 7 it is to be noted finally that in areas and under operations with difficult weather conditions, embodiments with a swivel can be the only solution, whereas in other areas having more stable weather, it may be possible to carry out the operations without any swivel incorporated in the system.

Immediately above there has been described a variant of the system that in similarity to the embodiment of FIG. 7, is based on a concept that does not employ a swivel. The difference between these two system designs is seen in how the product riser and the control or umbilical cable are extended from the seabed to the vessel. FIG. 7 describes a system where the product riser and the umbilical are attached to the drilling riser and are extended up through the moon pool of the vessel. In the alternative system design the product riser and the umbilical are arranged independently of the drilling riser and are taken in abaft on the vessel.

Figure 8:
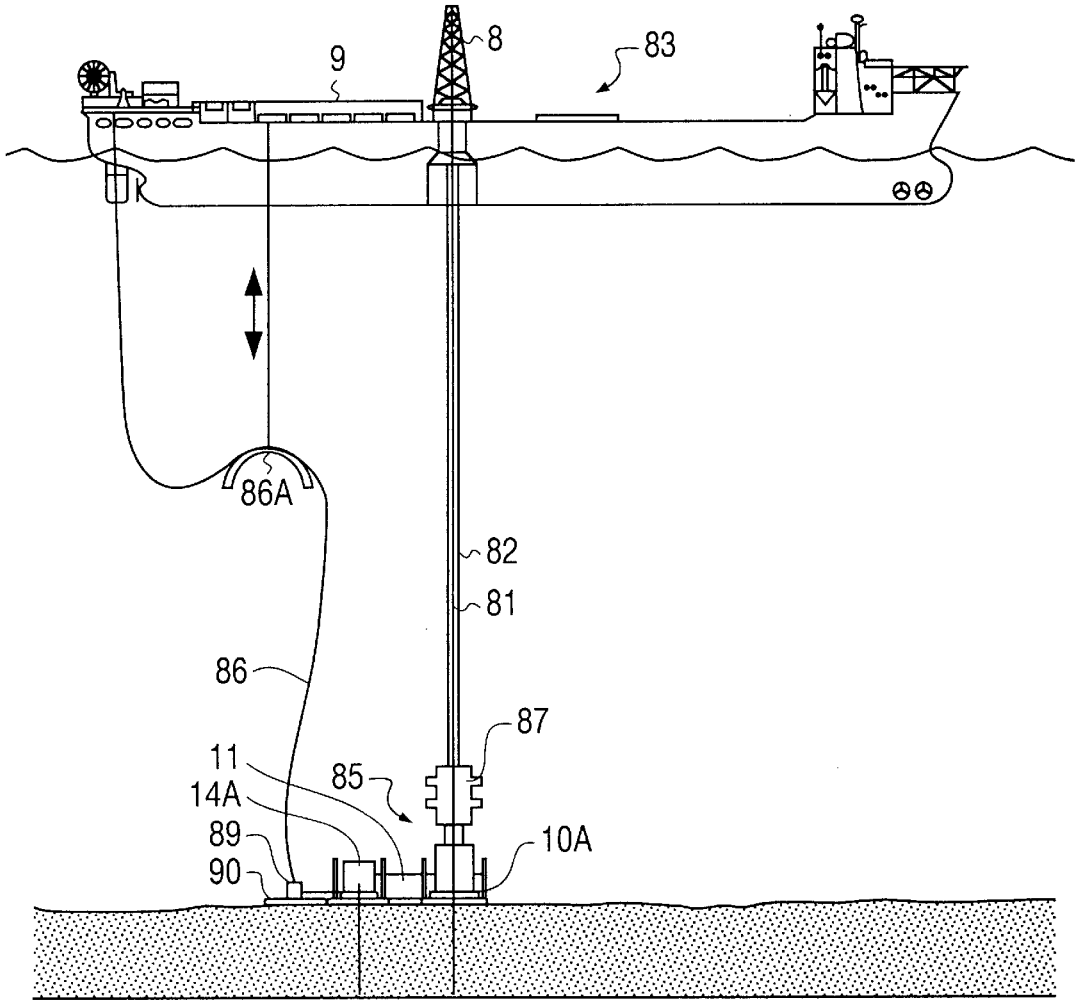
FIG. 8 shows a further embodiment of the system, whereby the product riser and the drill string are separately connected at two positions on the bottom installation.
Figure 8A:
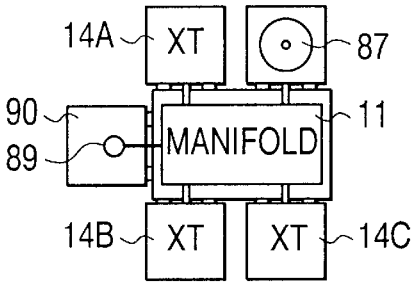
FIG. 8A shows an enlarged view of an example of a bottom installation.

The latter system variant is illustrated in FIG. 8, which in many ways can be compared to the arrangement of FIG. 1. Thus the surface vessel 83 in FIG. 8 has its drilling equipment 8 connected to blowout preventer 87 at a bottom installation 85 through a drilling riser 82 with a drill string 81. Also here a product riser 86, possibly together with an umbilical (not shown) are extended upwards from bottom installation 85 over a heave-compensated guide 86A to the abaft end of vessel 83. In this embodiment however, product riser 86 enters the bottom installation at a distance from blowout preventer 87, i.e. at a specific connecting position or section 90 with a connector device 89. The arrangement of such a specific bottom installation is schematically shown in FIG. 8A, where otherwise there is incorporated a manifold 11, three Christmas trees 14A, 14B and 14C as well as the above blowout preventer 87 which occupies one of the four wellhead sections comprised by this bottom installation, in this respect corresponding closely to the arrangement of FIG. 2. Also as regards many other main features the particular system of FIG. 8 corresponds to aspects of the embodiments described above.

The important embodiments comprising a swivel unit, in actual practice for combined production and drilling, typically will comprise the following functions and dimensions:

- one or two production bores of typical diameter 6",
- control functions with 8–16 channels for electrical signals and power as well as hydraulic pressure,
- the swivel/operation module can be installed and retrieved by means of a subsea tool,
- a through-going, central hole of approximately 20" for drilling,
- production coupling according to common standard to the subsea manifold,
- arrangement of couplings, conduits or connections according to common standard for connecting control functions to Christmas trees at the bottom installation,
- locking down the swivel/operation module by means of locking profiles according to common standard.

Necessary and sufficient operation steps incorporated in a method for producing oil or gas with a system as described above, are defined in claim 25. The method is to be explained in the following description in the form of a practical example with reference to FIGS. 9A–9E. This example is associated with the arrangement of FIG. 2 and preferably a swivel/operation module according to FIG. 4 or FIG. 5.

Figure 9A:
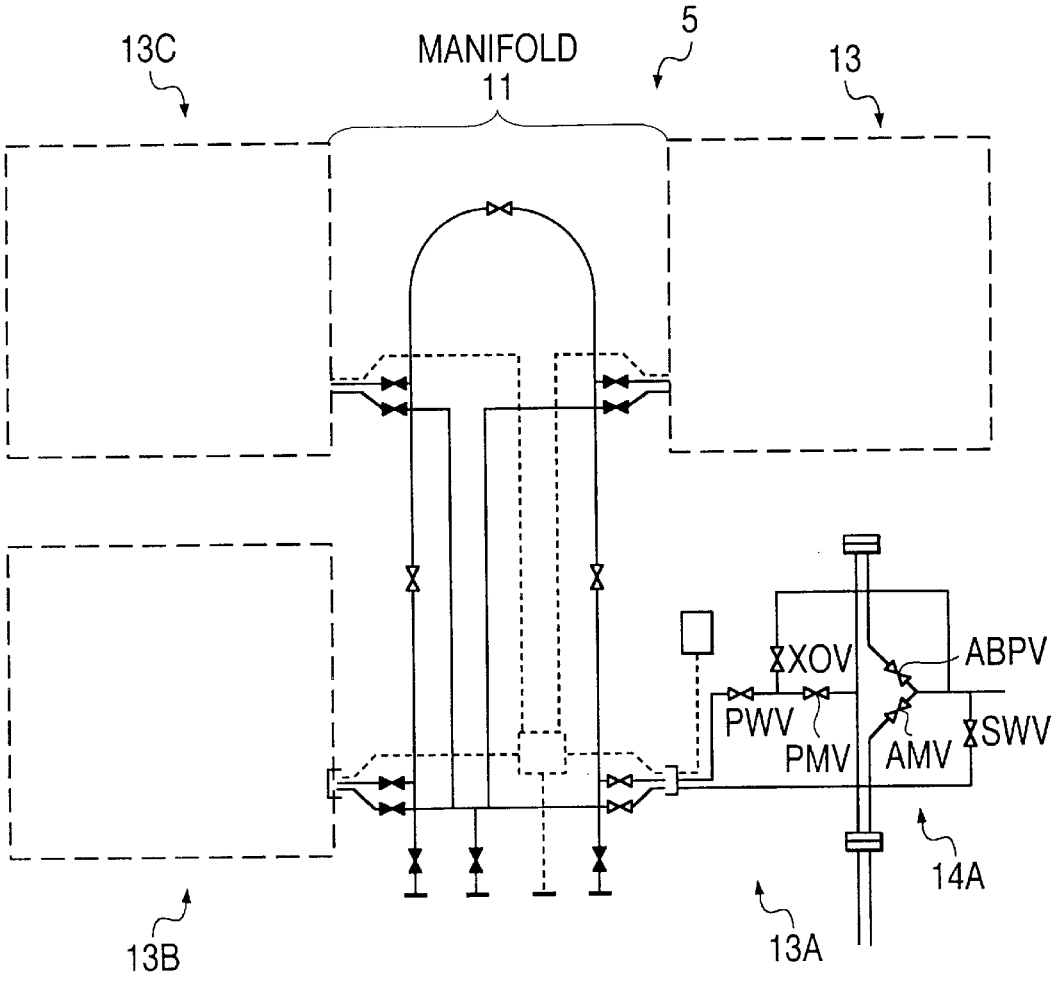
FIGS. 9A–9E illustrate a typical development of operation sequences with drilling, completing and production of four wells on a common bottom installation.
Figure 9B:
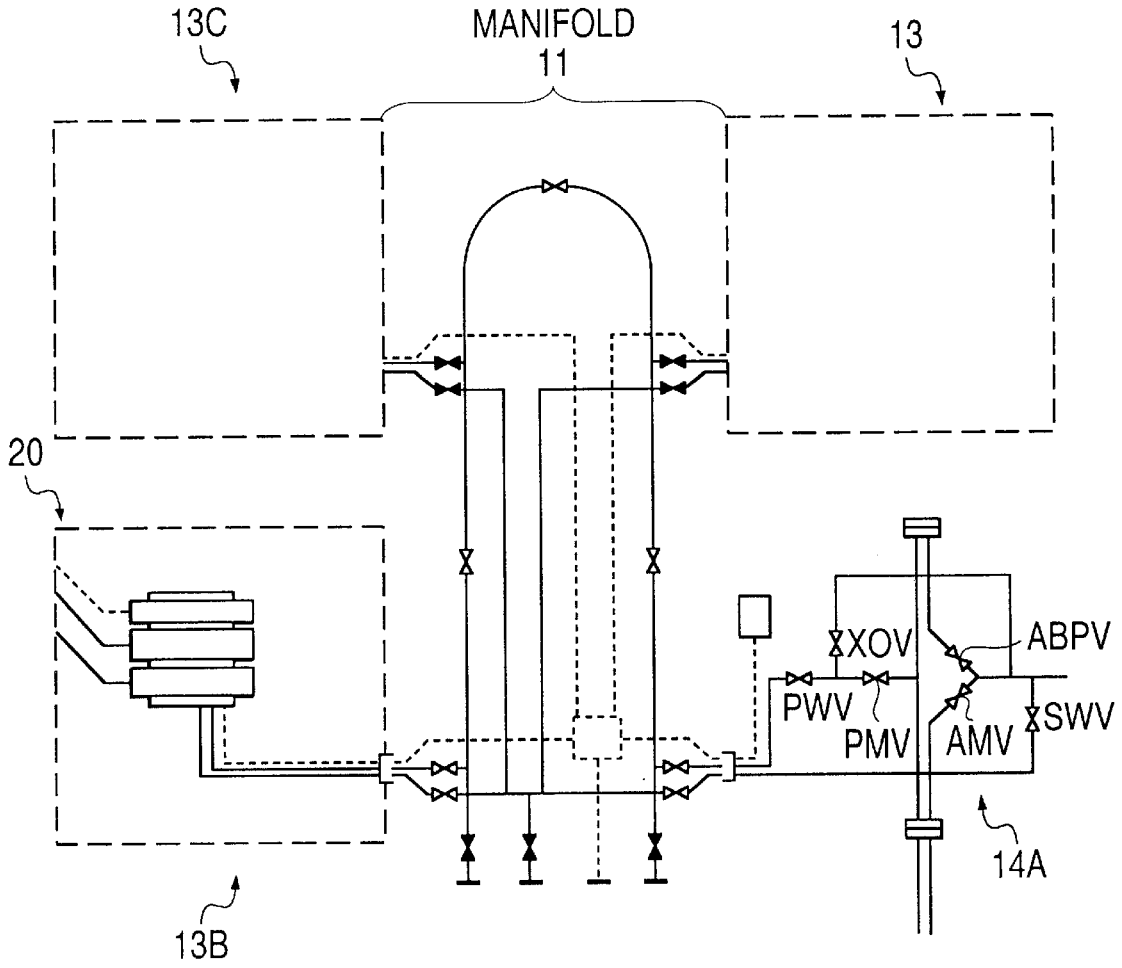

As initial operations the template and the manifold 11 with wing elements are installed in the usual way, and then a first well is drilled and completed in a traditional manner, namely at wellhead section 13A as illustrated in FIG. 9A. There is also shown an installed Christmas tree 14A. Thus in the situation of FIG. 9A a well is completed and is ready for production.

Then drilling of well No. 2 is started and in that connection there are installed in turn in the usual way, a conductor tube (B 30") and a casing/wellhead (20"/18 ¾"). The drilling operation takes place in the usual way in an open hole without a BOP and riser in the first instance, and in this phase the resulting drill cuttings from the bore hole will be discharged directly to the surrounding seabed. When the wellhead has been installed in this well No. 2, the swivel/operation module 20 with associated product riser and umbilical, will be installed on the wellhead or possibly on top of the conductor tube structure. Besides, it is possible to install the blowout preventer with its drilling riser so that the drilling operation can continue according to normal practice. Thereupon the first well is connected to module 20 and thereby is connected to the surface system, so that production can start from the first well in parallel to the drilling of well No. 2. This is shown schematically in FIG. 9B.

Thus, in this situation well No. 1 is connected through swivel module 20, the product riser and the umbilical to the process equipment at the surface vessel. The well flow or product is now controlled from well No. 1 through its Christmas tree 14A and further through the central manifold 11 and from there to swivel module 20. As explained above it is important in this context that swivel/operation module 20 has the same standard interface or coupling arrangement as a production Christmas tree being preferably of common standard.

Figure 9C:
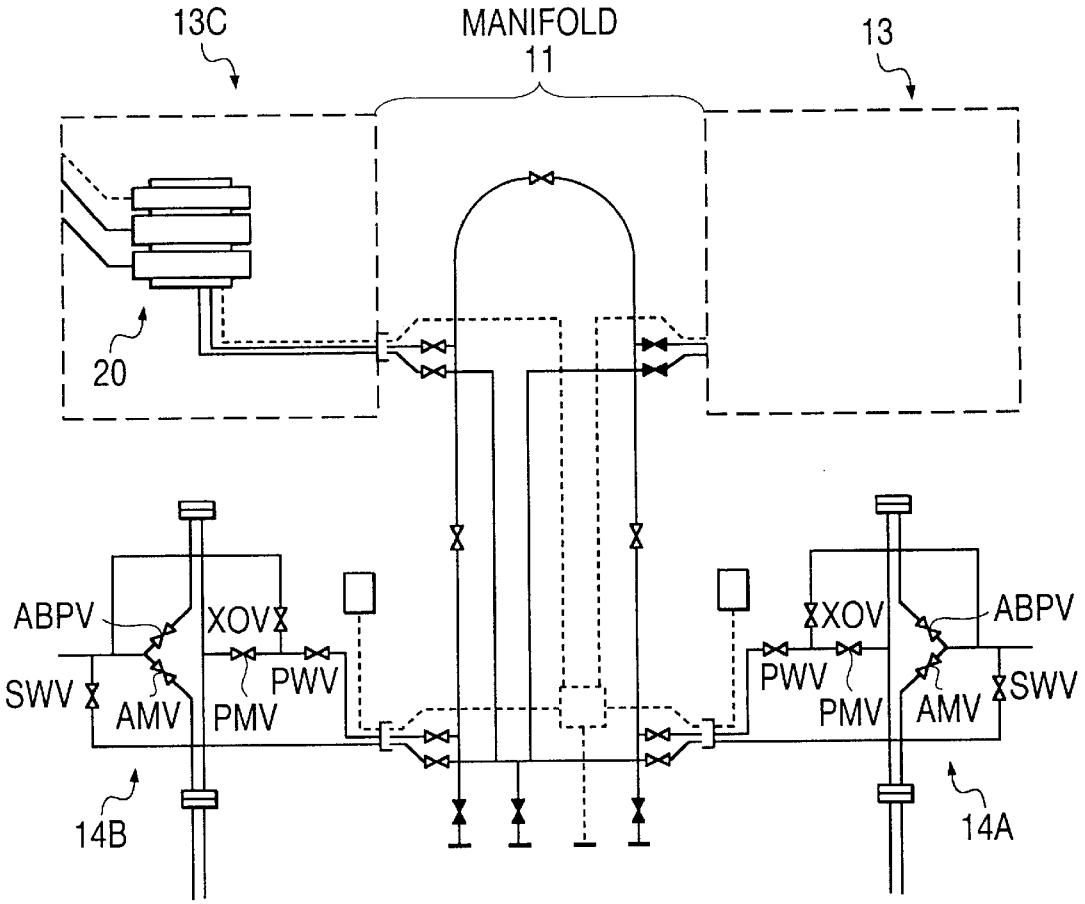

Upon termination of the drilling of well No. 2 and completion thereof, the blowout preventer and the swivel module 20 are retracted and drilling of well No. 3 is started in the usual way corresponding to the initial drilling of well No. 2, as discussed above. Also conductor and casing tubes are in turn set and subsequently the blowout preventer with the integrated swivel module 20 is installed on well No. 3. FIG. 9C shows this situation, where production from and control of wells 1 and 2 takes place through swivel module 20 at the same time as the main part of the drilling of well No. 3 goes on. At this point it is to be noted that in the relatively short period while the drilling of a new well is initiated and up to the installation of the associated casing/wellhead, it can be difficult to obtain a simultaneous and uninterrupted production from the previously completed wells, i.e. the two first wells with their associated Christmas trees 14A and 14B, as illustrated in FIG. 9C.

Figure 9D:
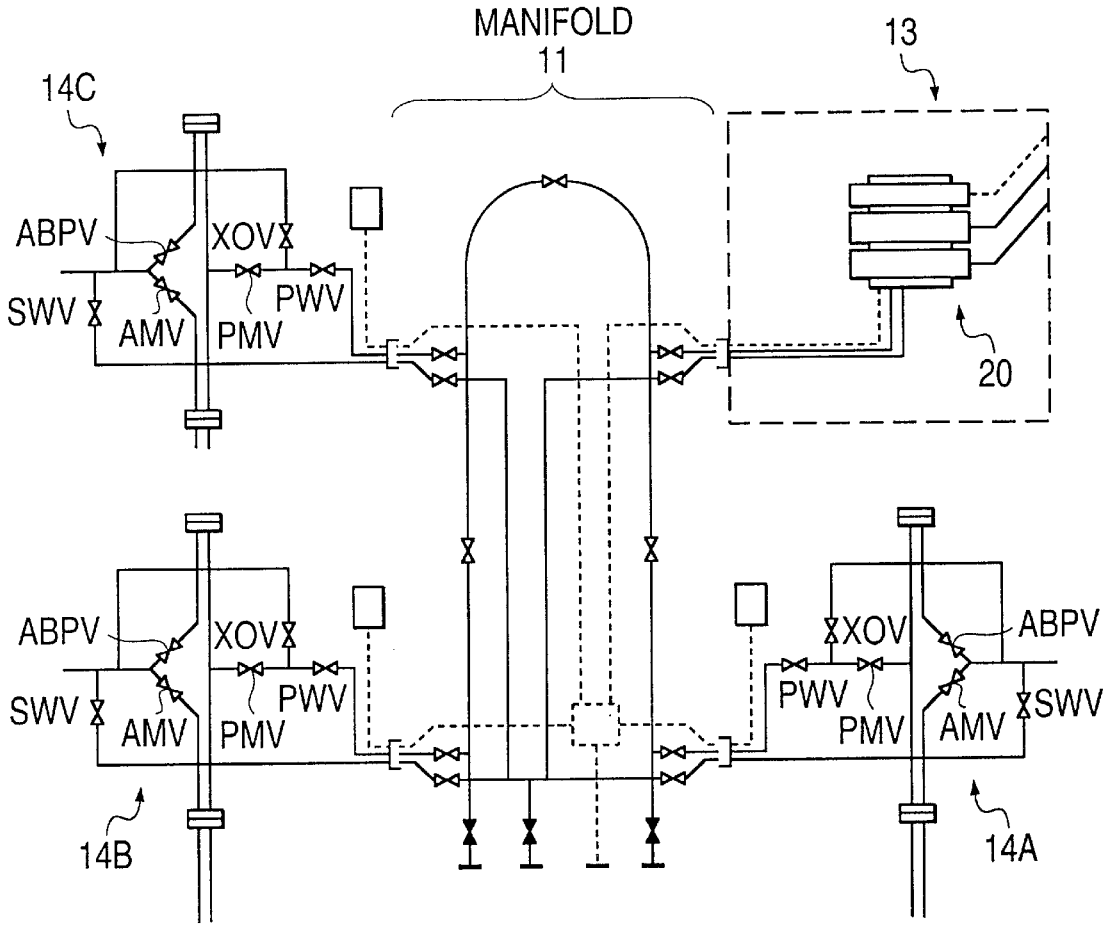

FIG. 9D shows the drilling of well No. 4 at the same time as wells. Nos. 1, 2 and 3 deliver their product or well flows through swivel/operation module 20 which is mounted on well No. 4.

Figure 9E:
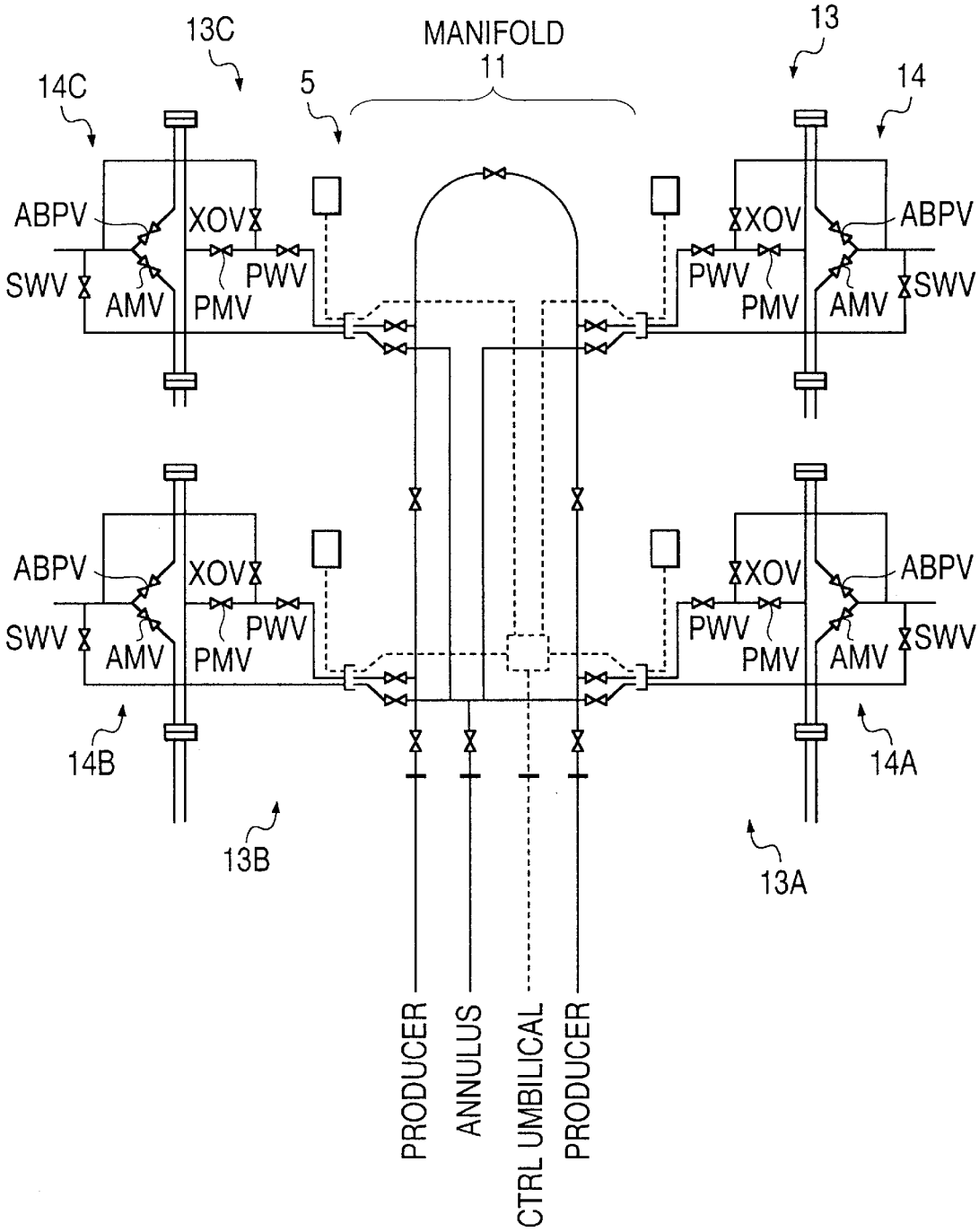

Finally FIG. 9E shows a situation where the drilling of all the wells at the bottom installation concerned, are terminated. The four wells now deliver their products to a surface installation through manifold 11. When such a production phase has been established upon finishing of the drilling, it will accordingly not be required to use the special surface vessel which has both drilling equipment and process modules, as was described and illustrated previously. It is possible however, that when the desired number of wells have been drilled, completed and put into production, the operation module 20 can still be incorporated in the system located on the last completed of the wells. This, however, as a rule is not what is preferred in actual practice.

Upon final completion of all wells, the production will normally be directed through pipelines to a platform or a surface installation being located somewhat away from the subsea installation. An alternative solution in this connection is to move the swivel module over to a dedicated section of the bottom installation and to produce directly to a floating installation located in the neighbourhood. In many cases this will lead to significant savings in the form of lower pipeline cost.

As shown in FIG. 3 several templates can be tied together in a common bottom installation, and in such case the production from templates being completed and ready, can be delivered through a swivel/operation module located on the template and the well or wellhead section in which drilling is currently taking place.

In the embodiments described and illustrated, a template of known form from actual practice has been taken as a starting point, but in this respect the invention is independent of the particular arrangement of template and configuration as well as the number of wellhead sections therein. A detail of interest in this connection is that guide posts being possibly employed at the bottom installation or the template in connection with installation thereof or components thereon, can be designed to be disassembled so that they can be removed in order not to be of any hindrance to the rotary movements of the swivel unit and the associated risers.

What is claimed is:

1. A system for offshore production of oil or gas, comprising a surface vessel having an apparatus for maintaining a desired position and orientation;

a bottom installation at a seabed for at least two production wells; and at least one riser for connecting the bottom installation to the vessel;

wherein the vessel is provided with drilling equipment for wells at the seabed and with process equipment for produced oil or gas;

wherein the bottom installation comprises a template having a foundation at the seabed, and provided with a manifold unit and designed with at least two wellhead sections adapted for installation of associated christmas trees;

and further comprising a drill string adapted to extend from the drilling equipment at the vessel, and a movable operation module adapted to be installed on the bottom installation and to be connected to a lower end of the drill string; and wherein the at least one riser includes a product riser adapted to connect the operation module to the process equipment on the vessel.

2. The system according to claim 1, further comprising:

a swivel unit having a vertical axis, in association with the product riser.

3. The system according to claim 2, wherein the swivel unit is located on the vessel.

4. The system according to claim 2, wherein the swivel unit is incorporated in the operation module.

5. The system according to claim 4, wherein the operation module includes a blowout preventer and the swivel unit is located underneath said blowout preventer.

6. The system according to claim 4, wherein the product riser extends upwards through the water for connection at the vessel at a point at a distance from the drilling equipment.

7. The system according to claim 6, wherein the product riser extends up through the water in an approximate S-shape with an upwardly curved, elevated middle portion of the product riser.

8. The system according to claim 4, wherein the product riser extends upwards through the water for connection at the vessel at a point at a distance from the drilling equipment, abaft on the vessel.

9. The system according to claim 2, wherein the swivel unit is motor-driven.

10. The system according to claim 2, wherein the swivel unit has a through-going axial hole for the drill string.

11. The system according to claim 2, wherein the swivel unit is motor-driven under control by said apparatus for maintaining the vessel at a desired position and orientation.

12. The system according to claim 1, wherein the product riser is attached along a drilling riser for the drill string.

13. The system according to claim 1, wherein the vessel is provided with an apparatus for dynamic positioningl/orientation.

14. A vessel comprising;

drilling equipment for wells at a seabed and process equipment for produced oil and gas;

an apparatus for maintaining a desired position and orientation at the sea surface; and an apparatus for controlling a swivel unit, in association with said position maintaining apparatus for maintaining a desired position and orientation, being based on dynamic positioning and orientation.

15. The vessel according to claim 14, equipped with a swivel unit for an upper end of a product riser.

16. The vessel according to claim 14, wherein the drilling equipment includes an associated work opening and is located generally midship, and wherein the process equipment is located abaft.

17. The vessel according to claim 16, wherein the process equipment includes associated coupling for the product riser.

18. A bottom installation comprising;

a template having a foundation at a seabed, wherein the template is provided with a manifold unit and is designed with at least two wellhead sections adapted for installation of associated christmas trees; and a movable operation module adapted to establish a rotatable connection to a riser extending to a surface vessel.

19. The bottom installation according to claim 18, wherein the movable operation module includes a swivel unit which is motor-driven.

20. The bottom installation according to claim 19 wherein the moveable operation module includes a blowout preventer and the swivel unit is located underneath said blowout preventer.

21. The bottom installation according to claim 18 wherein the movable operation module includes a blowout preventer and the swivel unit is located over said blowout preventer.

22. The bottom installation according to claim 19 wherein the operation module has a through-going axial hole for a drill string.

23. The bottom installation according to claim 18, wherein the operation module at a lower portion has an interface of the same type as christmas trees intended for being landed and connected to said wellhead sections.

24. The bottom installation according claim 18, wherein the operation module is provided with a guide yoke adapted to hold product risers extending laterally and at an inclination upwards, with a clearance in relation to remaining components and equipment on the template.

25. A bottom installation according to claim 18, wherein the movable operation module includes a swivel unit.

26. A system for offshore production of oil or gas, comprising;

a surface vessel equipped with an apparatus for maintaining a desired position and orientation;

a bottom installation at a seabed for at least two production wells; and risers for connecting the bottom installation to the vessel;

wherein the vessel is provided with drilling equipment for wells at the seabed and with process equipment for produced oil or gas;

wherein the bottom installation comprises a template having a foundation at the seabed, and provided with a manifold unit and designed with at least two wellhead positions or sections adapted for installation of associated christmas trees;

and further comprising a drill string adapted to extend from the drilling equipment on the vessel to a blowout preventer on the bottom installation; and wherein the risers include a product riser adapted to connect one or more production wells on the bottom installation to the process equipment on the vessel.

27. A method of producing oil or gas with a system including a surface vessel, a bottom installation for at least two production wells and provided with a manifold unit and a plurality of wellhead sections, and at least one riser for connecting the bottom installation to the vessel comprising;

deploying said bottom installation at a seabed and positioning said vessel at the sea surface above the bottom installation;

drilling and completing a first well at one of said plurality of wellhead sections;

initially drilling a second well at a second one of said plurality of wellhead sections;

setting down an operation module with one of said at least one risers for landing and connection at the second one of said plurality of wellhead sections and additionally drilling and completing the second well;

establishing production from the first well through said manifold and the operation module at the second one of said plurality of wellhead sections contemporaneous with the additional drilling of the second well;

drilling a corresponding third well from a third one of said plurality of wellhead sections and subsequently establishing production through the operation module from the third well.

28. The method of producing oil or gas according to claim 27, wherein the step of initially drilling the second well comprises:

installing both conductor and casing tubes for the second well.

29. The method of producing oil or gas according to claim 27, further comprising:

additionally drilling one or more new wellhead sections;

disconnecting and removing the operation module from the one or more new wellhead sections after a desired number of wells have been drilled, completed and put into production.

30. The method of producing oil or gas according to claim 27, further comprising:

additionally drilling one or more new wellhead sections;

finally locating the operation module at a dedicated section of the bottom installation separated from the new well head sections.

* * * * *